US006142315A

United States Patent [19]

Arout

[11] Patent Number: 6,142,315

[45] Date of Patent: Nov. 7, 2000

[54] DISPLAY RACK

[76] Inventor: John Arout, 96 Holcomb Ave., Staten Island, N.Y. 10312

[21] Appl. No.: 09/412,530

[22] Filed: Oct. 5, 1999

[51] Int. Cl.[7] ..... A47F 7/16

[52] U.S. Cl. ..... 211/45; 248/473

[58] Field of Search ..... 211/45, 46, 41.12; 40/642.02, 649, 657, 124, 124.2; 248/473, 460, 461, 463, 454–456

[56] References Cited

U.S. PATENT DOCUMENTS

| | | | |
|---|---|---|---|
| D. 353,412 | 12/1994 | Bull et al. | 211/45 X |
| D. 397,735 | 9/1998 | Spranger | 248/456 X |
| 1,616,602 | 2/1927 | Williams . | |
| 2,742,292 | 4/1956 | McDonough | 248/456 |
| 2,785,901 | 3/1957 | McLemore | 211/45 X |
| 2,949,192 | 8/1960 | Maliff . | |
| 3,210,865 | 10/1965 | Muntz | 211/45 X |
| 3,361,131 | 1/1968 | Barger | 211/45 X |
| 4,291,882 | 9/1981 | Del Monte | 40/124 |
| 4,295,623 | 10/1981 | Schweizer | 248/456 |
| 4,323,214 | 4/1982 | DeLuca | 248/461 |
| 4,453,714 | 6/1984 | Houser | 40/124 |
| 4,468,032 | 8/1984 | Stewart | 40/124.2 |
| 4,685,647 | 8/1987 | Calhoun | 248/473 |
| 4,757,623 | 7/1988 | Seyler | 40/657 |
| 4,863,020 | 9/1989 | Klemow | 206/328 |
| 4,948,092 | 8/1990 | Pagano | 248/460 |
| 4,976,409 | 12/1990 | Hansen | 248/473 |
| 5,485,928 | 1/1996 | Felton | 211/52 |
| 5,636,752 | 6/1997 | Gallagher | 211/41.12 |
| 5,695,073 | 12/1997 | Klein et al. | 211/35 |
| 5,823,332 | 10/1998 | Clausen | 211/41.12 |
| 5,862,922 | 1/1999 | Gallagher | 211/41.12 |
| 5,873,472 | 2/1999 | Weisburn | 211/41.12 |
| 5,927,674 | 7/1999 | Snyder, Jr. | 248/456 |
| 6,059,123 | 5/2000 | Cotutsca | 211/40 |

*Primary Examiner*—Blair M. Johnson
*Assistant Examiner*—Jennifer E. Novosad
*Attorney, Agent, or Firm*—Goldstein & Canino

[57] ABSTRACT

A display device for displaying various objects, comprising a front surface, a rear surface, side surfaces, a top surface, and tiers of descending height from the rear toward the front. A slot is located behind each tier for accommodating the object. The slot has a shallow thick portion and a deep thin portion. A vertical support mechanism includes a pair of brackets which selectively pivot upward or store horizontally downward against the rear and top surfaces, and a pair of poles which are selectively mounted within pole seats in the top surface, or are stored within pole sleeves which extend into one of the side surfaces.

3 Claims, 4 Drawing Sheets

DISPLAY RACK

BACKGROUND OF THE INVENTION

The invention relates to a universal display rack. More particularly, the invention relates to a rack which supports in a vertical position a variety of objects which are otherwise not free-standing items.

When it is desirable to display a non-freestanding item in a vertical position, some type of base is necessary to rigidly hold the item, so that it's center of gravity remains above some portion of the base. To accomplish the necessary rigid connection with the item, the base must typically be particularly tailored to fit the item it is supporting.

One attempt at a universal base are the slotted racks often used in retail display. The slots are typically arranged in a multi-tiered rack that extends several feet in height. Most typically, greeting cards are displayed for sale in this manner. An example of such a rack is disclosed by Wegscheid et al. in U.S. Pat. No. 5,720,396.

U.S. Pat. No. 5,289,926 to Lewis et al. discloses a display rack which is die cut and folded to form a terraced display rack for displaying baseball cards or the like. U.S. Pat. No. 5,485,928 to Felton discloses a merchandise display rack. U.S. Pat. No. 5,695,073 to Klein et al. discloses a hanging shoe rack.

U.S. Pat. Nos. 2,949,192 to Maliff; 4,573,591 to Chap; and 4,863,020 to Klemow disclose various multi-tiered display racks.

While these units may be suitable for the particular purpose employed, or for general use, they would not be as suitable for the purposes of the present invention as disclosed hereafter.

SUMMARY OF THE INVENTION

It is an object of the invention to produce a display rack which is capable of supporting a variety of objects in a vertical position, which could not otherwise stand vertically. Accordingly, a stand is provided which supports a variety of items by using a variety of support structures.

It is another object of the invention to provide a display rack which is particularly well suited for displaying playing cards. Accordingly two or more thin slots are provided which hold the playing cards in a substantially vertical position.

It is a further object of the invention to provide a display rack which is capable of supporting a larger item, such as a picture frame, sheets of paper, a plate, or the like. Accordingly, vertical supports are selectively deployable to provide addition vertical support therefor.

The invention is a display device for displaying various objects, comprising a front surface, a rear surface, side surfaces, a top surface, and tiers of descending height from the rear toward the front. A slot is located behind each tier for accommodating the object. The slot has a shallow thick portion and a deep thin portion. A vertical support mechanism includes a pair of brackets which selectively pivot upward or store horizontally downward against the rear and top surfaces, and a pair of poles which are selectively mounted within pole seats in the top surface, or are stored within pole sleeves which extend into one of the side surfaces.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
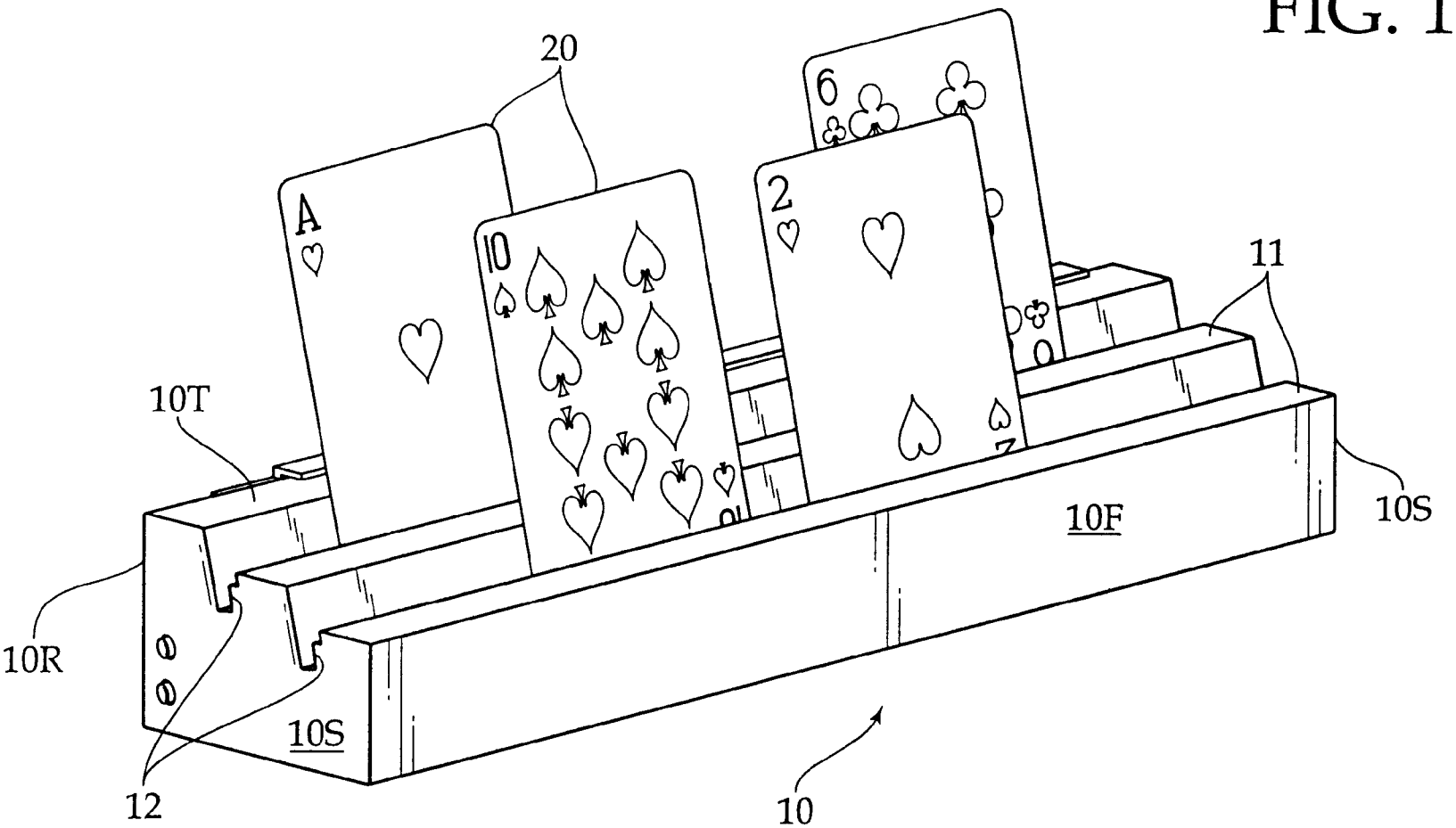
FIG. 1 is a diagrammatic perspective view showing the display rack in use holding playing cards within the slots, wherein the retractable brackets have been folded horizontally downward, and wherein the poles are located in their storage sleeves.

FIG. 1 illustrates a display rack 10, comprising a front 10F, sides 10S, a rear surface 10R, and a top surface 10T. The display surface comprise several levels, or tiers 11 which are lower than the top surface 10T, and descend therefrom in a stepped fashion from the rear surface 10R toward the front surface 10F. The display rack 10 comprises several slots 12 which extend downward from the tiers 11 directly behind each tier 11, and thus generally separate the various tiers 11, and separate the top surface 10T from the tier 11 nearest thereto. As seen in FIG. 1, playing cards 20 may be conveniently held in the slots 12, and displayed thereby.

Figure 5:
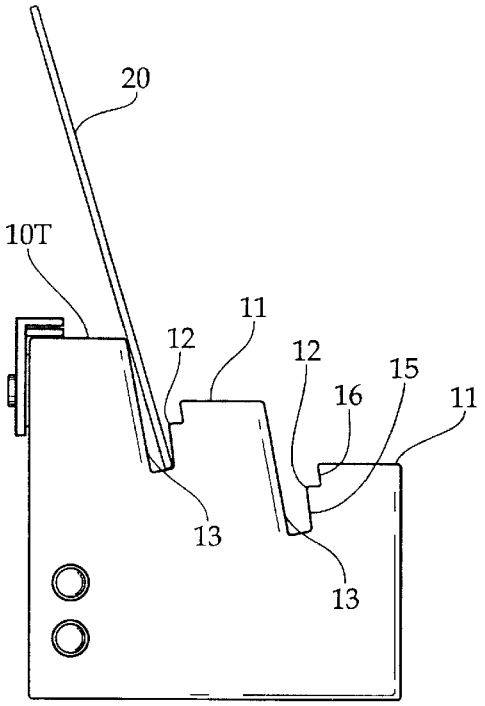
FIG. 5 is a side elevational view, illustrating a playing card supported within one of the slots.
Figure 6:
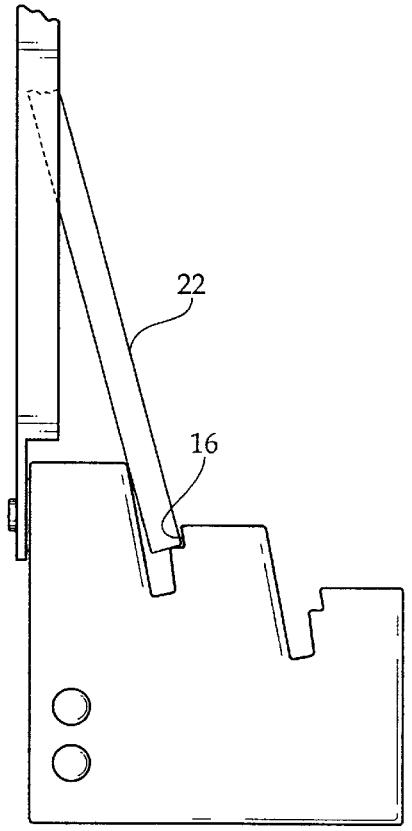
FIG. 6 is a side elevational view, illustrating a thick object, such as a picture frame, being supported in the widened portion of one of the slots, and leaning against one of the brackets.

Referring to FIG. 5, the slots 12 are preferably of compound thickness, having a deep thin portion 15, extending deeply below adjacent tier surfaces 11, and a shallow thick portion 16, extending a short distance from adjacent tier surfaces 11. The deep thin portions 15 of the slots 12 allow thin objects, such as the playing cards 20 to be supported therein. Referring to FIG. 6, the shallow thick portions 16 allow for support of thicker objects, such as a picture frame 22. The slots 12 extend immediately behind each tier 11. Each slot has a slot rear 13 which adjoins the tier 11 immediately therebehind, or the top surface 10T. In addition, it is apparent in FIG. 6 that the slots 12 lean toward the rear 10R.

Figure 2:
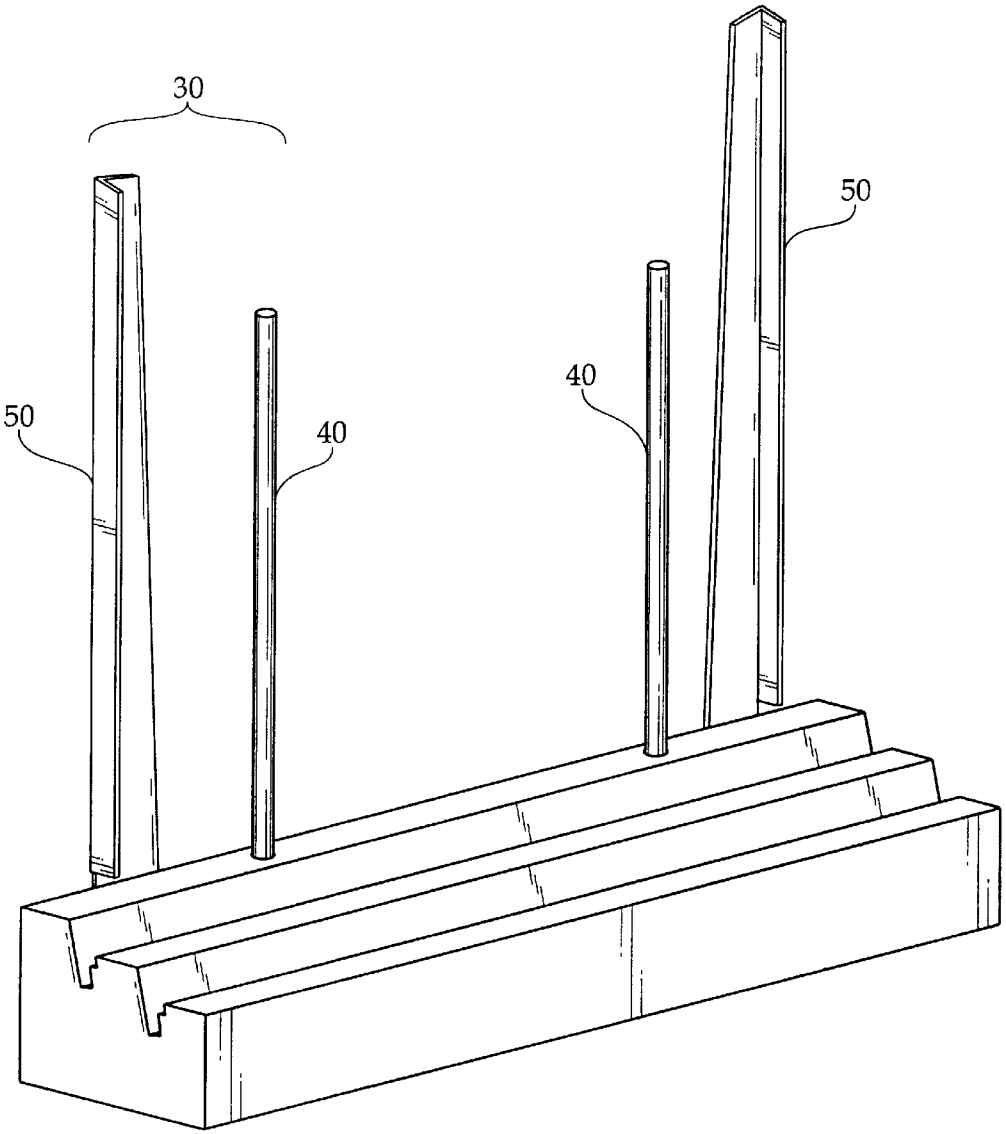
FIG. 2 is a diagrammatic perspective view of the invention, wherein the retractable brackets are in their vertical extended positions, and wherein the poles are located in the pole seats.

Referring now to FIG. 2, various rear support devices 30 may be employed to provide additional support to objects which are held within the slots 12. The rear support devices 30 can comprise a pair of poles 40, and a pair of brackets 50.

Figure 3:
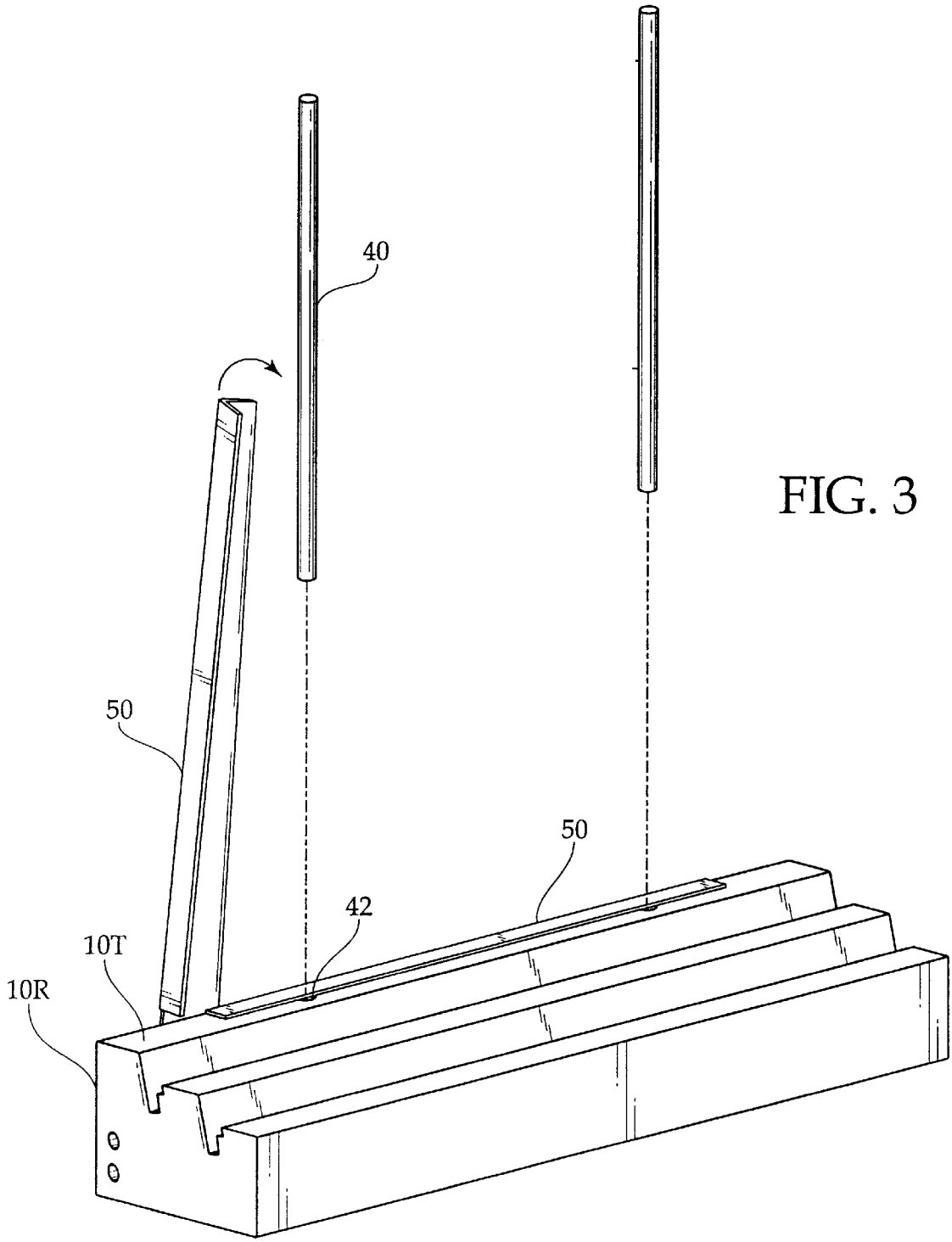
FIG. 3 is a diagrammatic perspective view, illustrating the poles being removed from the pole seats, and the retractable brackets being folded downward for storage.

Referring to FIG. 3, the poles 40 may be removably held in pole seats 42. The pole seats 42 are of substantially the same diameter as the poles 40, to ensure a snug fit therein. Also shown in FIG. 3, the brackets 50 are hingeably attached to the rear surface 10R, near the top surface 10T. As illustrated in FIG. 3, the poles 40 are being removed from the pole seats 42, one of the brackets has been swung down to its horizontal storage position against the top surface 10T, while the other bracket 50 is about to be swung downward.

Figure 4:
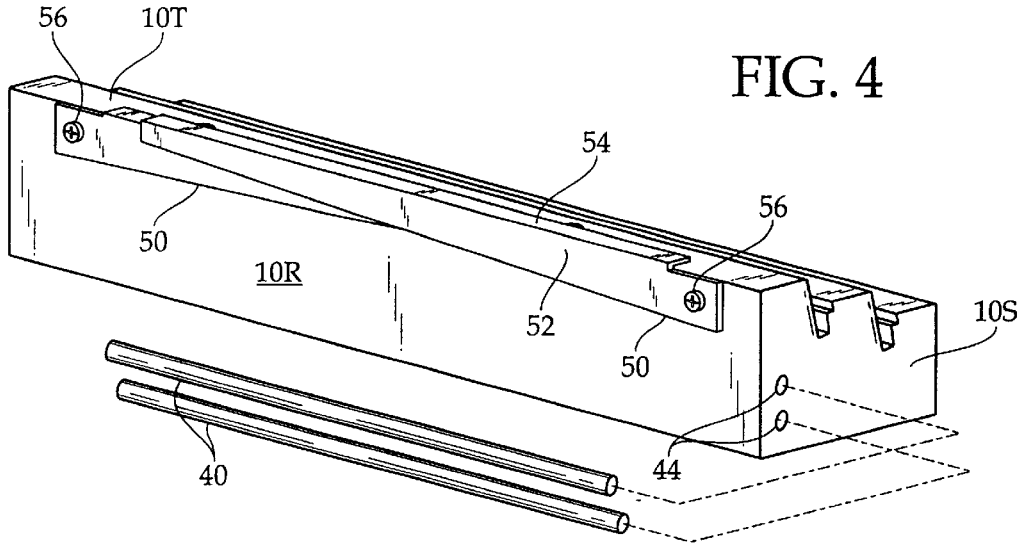
FIG. 4 is a rear perspective view, illustrating the poles being stored in the pole storage sleeves.

Referring to FIG. 4, once the poles 40 have been fully removed from the pole seats 42, they may be stored in pole sleeves 44, which extend horizontally into one of the sides 10S. Also illustrated in FIG. 4, the brackets 50 each generally comprise a first panel 52 and a second panel 54 which together form a right angle. The first panel 52 is connected to the rear surface 10R at a pivot point 56. When one of the brackets 50 extends horizontally in its storage position, the first panel 52 rests substantially flush against the rear surface 10R, and the second panel 52 rests substantially flush against the top surface 10T. Since the pivot points are located toward opposite sides 10S, the brackets 50 each pivot inward, and the second bracket to be pivoted downward overlaps the first of said brackets 50.

For use, either the brackets 50 may be pivoted upward or the poles may be seated within the pole seats 42 to support a large vertical object, or the brackets 50 may remain downward, and the poles 40 stored, while the object simply rests against the slot rear 13.

It should be apparent from the foregoing discussion that any of a variety of objects can be supported by the universal display rack as disclosed herein, including the examples given of playing cards and picture frames. Other examples of objects suitable for display include, papers of various kinds, sheet music, and decorative objects such as tiles and plates.

In conclusion, herein is presented a display rack which allows an object to be supported in a vertical position for effective and stable display.

What is claimed is:

1. A display rack, for displaying objects, comprising:

a front surface, a rear surface, a top surface, and side surfaces;

two or more substantially horizontal tiers which are progressively lower in height than the top surface moving from the rear surface toward the front surface;

a slot immediately behind each of the tiers, having a slot thickness for accommodating the object, wherein each slot leans toward the rear surface and comprises a shallow thick portion and a deep thin portion; and a vertical support device selectively extending above the top surface for providing support to the object, wherein said vertical support device further comprises:

a pair of brackets which are each selectively pivotable between a position wherein said bracket extends horizontally along the top surface and a position wherein said bracket extends vertically upward from the top surface, and a pair of poles, and a pair of pole seats in the top surface for selectively allowing the poles to fit securely therein for supporting the object.

2. The display rack as recited in claim 1, further comprising pole storage sleeves, located in one of the side surfaces, sized for allowing the poles to be selectively stored therein.

3. The display rack as recited in claim 2, wherein each bracket further comprises a first surface and a second surface, wherein the first surface extending parallel to the rear surface and the second surface extends parallel to the top surface, wherein when said bracket extends horizontally, its first surface extends substantially flush against the rear surface and its second surface extends substantially flush against the top surface.

* * * * *